US005620038A

United States Patent [19]

DeCola et al.

[11] Patent Number: 5,620,038

[45] Date of Patent: Apr. 15, 1997

[54] SYSTEM FOR BRACING GARAGE DOOR AGAINST HURRICANE FORCE WINDS

[75] Inventors: Salvatore M. DeCola, Rockledge; Vernon Back, Cocoa, both of Fla.

[73] Assignee: Secure Door, Vertical Bracing Components Company, Inc., Rockledge, Fla.

[21] Appl. No.: 536,053

[22] Filed: Sep. 29, 1995

[51] Int. Cl.[6] ..... E05D 15/26

[52] U.S. Cl. ..... 160/209; 52/167.1; 52/167.3; 52/127.2; 52/741.3; 52/DIG. 12

[58] Field of Search ..... 160/209, 201; 52/167.1, 167.3, DIG. 12, 741.3, 745.09, 745.14, 127.2

[56] References Cited

U.S. PATENT DOCUMENTS

| | | | |
|---|---|---|---|
| 2,783,508 | 3/1957 | Keating . | |
| 3,853,166 | 12/1974 | Wrono | 160/201 X |
| 5,383,509 | 1/1995 | Gaffney et al. | 160/209 |
| 5,445,207 | 8/1995 | Romanelli et al. | 160/209 |

OTHER PUBLICATIONS

Advertising flyer from B.I.G. Manufacturing Corporation, Stuart, Florida, entitled "Automatic Garage Door Brace".

*Primary Examiner*—Robert Canfield

*Attorney, Agent, or Firm*—Charles E. Wands

[57] ABSTRACT

A garage door bracing arrangement for reinforcing the entire vertical extent of a multi-panel garage door against high velocity (e.g. hurricane-force) winds is comprised of a plurality of vertically extending door-stiffening column members. These door-stiffening column members are pivotally attached to upper mounting brackets affixed to the garage building structure directly above the garage door opening. Lower mounting brackets are affixed to second ends of the column members and are configured to be anchored to the garage floor directly beneath the upper mounting brackets. The door-stiffening column members are further attachable to deflection brackets that are mounted to the door panel hinge joints, so that the garage door panels are securely braced over the entire height of the garage door by an anchoring structure that prevents the garage door from being flexed off its guide tracks and becoming detached by the impact of or the vacuum created by intense winds. In addition, in its installed position, the garage door bracing arrangement of the present invention provides a security measure against intruders, as it prevents the garage door from being opened.

6 Claims, 4 Drawing Sheets

SYSTEM FOR BRACING GARAGE DOOR AGAINST HURRICANE FORCE WINDS

FIELD OF THE INVENTION

The present invention relates in general to garage door systems, and is particularly directed to a bracing arrangement for reinforcing and anchoring a semented panel-configured garage door against high velocity winds, so as to preclude the door panels from becoming detached during an intense storm, such as a hurricanes and thus averting greater damage to the garage interior and adjacent building structures in particular, preventing the entry of violent wind into the garage and building that would otherwise cause the roof to blow off.

BACKGROUND OF THE INVENTION

As diagrammatically illustrated in FIG. 1, the typical multi-panel configured garage door 10 used for residential construction is comprised of a plurality of panels 11 (usually made of galvanized steel or fiberglass), which are hinged together at hinge joints 13, and are equipped with side wheels or rollers 15 that ride in a pair of guide tracks 17, 18 installed on opposite sides of the garage door opening 19. The tracks 17, 18 are usually anchored (bolted) to wall regions 21 and 22 of the garage adjacent to opening 19 and attached via brackets 25 to the ceiling 26. The door may be opened and closed either by hand or by way of an automated garage door translation device, usually mounted to the ceiling and attached to the topmost one of the panels 11.

It has been found that, when such a door is exposed to high velocity winds of a violent storm, such as a hurricane, the door panels 11 have a tendency to separate from the guide tracks 17, 18, due to continued flexing of the panels and fatigue of the tracks themselves, causing the side wheels 15 to become detached from the tracks 17, 18, so that the ends of the panels 11 become warped, allowing wind to enter the garage and literally rip or 'peel' the door away from opening 19. Once the garage door has been blown out, the ceiling of the garage and adjacent structure are no longer protected from the extremely high velocity winds of the storm, and it is simply a matter of time before the roof blows off, causing the entire structure to be destroyed. Indeed, follow-up investigation to the widespread damage to residential buildings in south Florida by hurricane Andrew in 1992 has revealed that had garage doors been reinforced against such separation from the guide tracks, and not blown out, the full force of the hurricane would not have been able to enter many of the houses that were destroyed.

As a result of this investigation, home builders in coastal areas of south Florida are now required to provide 'hurricane reinforcement' for their garage doors. Recommendations of how to accomplish this have usually involved the installation of (metal or wooden) girts that extend horizontally across each panel. Such girts are intended to stiffen the panels and prevent their oscillatory motion that leads to the destructive separation from the tracks.

Unfortunately, such stiffening panels add considerable weight to the door, requiring adjustment of both the lifting-coil spring and of the drive of the automated garage door translation mechanism. Moreover, even with such adjustment, the added weight of the girts, for which neither the door nor the automated translation mechanism were originally designed, leads to further wear and tear of the automatic door opener. Yet, even with such stiffeners, the fundamental problem they are intended to solve is not remedied, since they do not prevent torquing of the panels at the point of attachment of the door to the tracks.

More particularly, because the girts extend in the horizontal direction, they are parallel to joint lines between the panels and effectively provide axes of rotation about which the panels are torqued when subjected to the force of high velocity winds. They do not provide reinforcement or a barrier against separation along the lengths of the tracks.

SUMMARY OF THE INVENTION

To solve these shortcomings the present invention provides a garage door bracing arrangement, comprised of a plurality of vertically extending door-stiffening column members that are configured to brace the entire height of the garage door against high velocity winds, thereby preventing any of the door panels from becoming detached as a result of intense winds, such as hurricane-force winds, and thus averting destruction to the garage interior and an adjoining building structure. In addition, the garage door bracing arrangement of the present invention provides a significant security measure against intruders, since, in its installed position, it prevents the garage door from being opened.

For this purpose, the garage door bracing arrangement in accordance with the present invention comprises a plurality of vertical door-stiffening column members, such as doubled (back-to-back) wooden two-by-fours, which are inserted into upper mounting brackets affixed to the garage building structure directly above the garage door opening. Lower mounting brackets are affixed to second ends of the column members and are configured to be anchored to the garage floor directly beneath the upper mounting brackets.

Each upper mounting bracket is generally U-shaped, having a pair of base flanges that project from side channel walls and are used to fasten the bracket to the garage wall structure. The channel is sized to receive an upper end of a door-stiffening column member. Holes may be provided in the side channel walls to secure the upper end of the door-stiffening column member by bolts or the like.

A lower mounting bracket has a generally U-shaped, vertically extending channel portion and a pair of base flanges. Once affixed to the lower end of a column member, via the U-shaped channel portion, the lower mounting bracket may be anchored to the garage floor by way of machine bolts which are secured to drop ins fitted into holes drilled into the floor, the machine bolts passing through holes in the flanges of the lower mounting bracket. When not in use, the drop ins are capped.

The door-stiffening column members are further attachable to deflection brackets. The deflection brackets are mounted to the door panel hinge joints, so that the garage door panels are securely braced over the entire height of the garage door. What results is an anchoring structure that prevents the garage door from being flexed off the tracks and becoming detached by the impact of intense winds, or as a result of the suction of the door outwardly from the vacuum created by intense cross winds.

To provide effective bracing of the side edge portions of the garage door against panel separation from the guide tracks, upper mounting brackets are installed to the garage building structure directly above the side edges of the garage door panels, with associated lower mounting brackets anchored to the garage floor directly beneath these upper mounting brackets. In addition, one or more additional pairs of upper and lower mounting brackets may be installed to the garage building structure between the side edges of the garage door opening, so as to provide additional bracing across the width of the garage door. Attaching the garage door to these additional column members minimizes the potential for flexing of the garage door panels, so that the garage door will be securely braced against intense winds.

DETAILED DESCRIPTION

Figure 1:
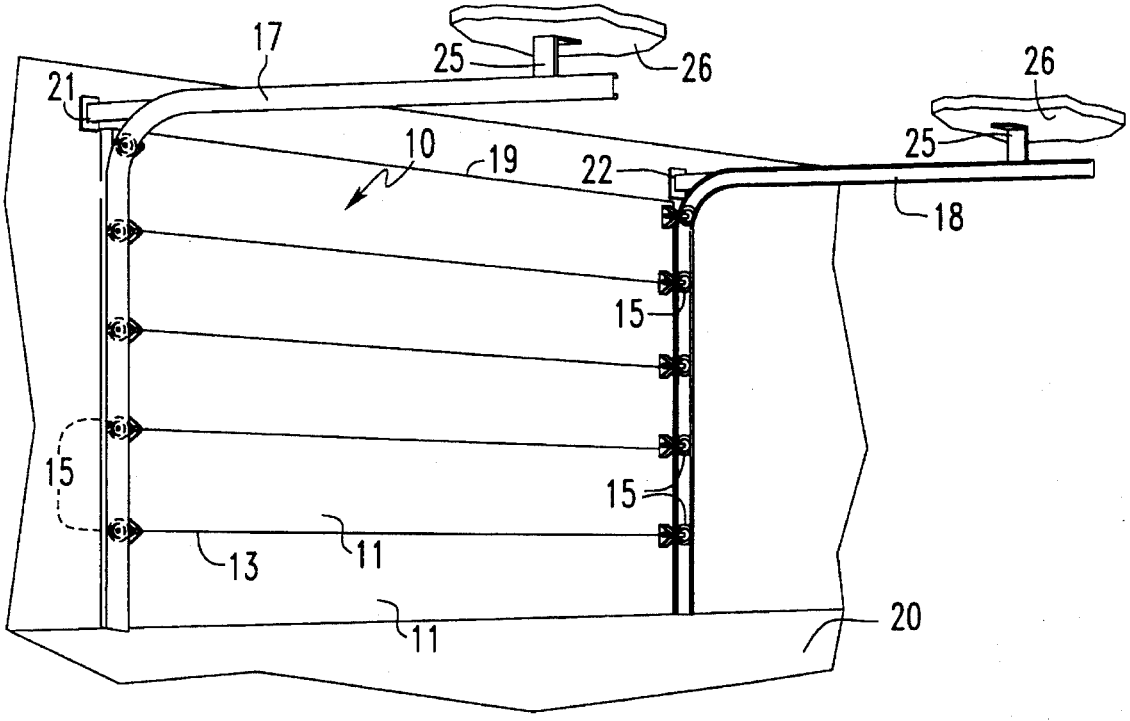
FIG. 1 PRIOR ART
FIG. 1 diagrammatically illustrates a conventional multi-panel configured garage door used for residential construction.

Referring now to FIGS. 2–5, the garage door bracing arrangement for reinforcing a segmented panel-configured garage door in accordance with the present invention is diagrammatically illustrated as comprising a plurality of vertically extending, door-stiffening column members 31. These door-stiffening column members 31 are inserted into to upper mounting brackets 33, that are affixed to the garage building structure directly above the garage door opening 19, and are securable to lower mounting brackets 35 that are anchored able to the garage floor 20 directly beneath the upper mounting brackets 33. As a non-limiting example, a respective column member 31 may comprise doubled (back-to-back) wooden two-by-fours, that are easily cut and drilled for attachment with the hardware fittings to be described.

Figure 3:
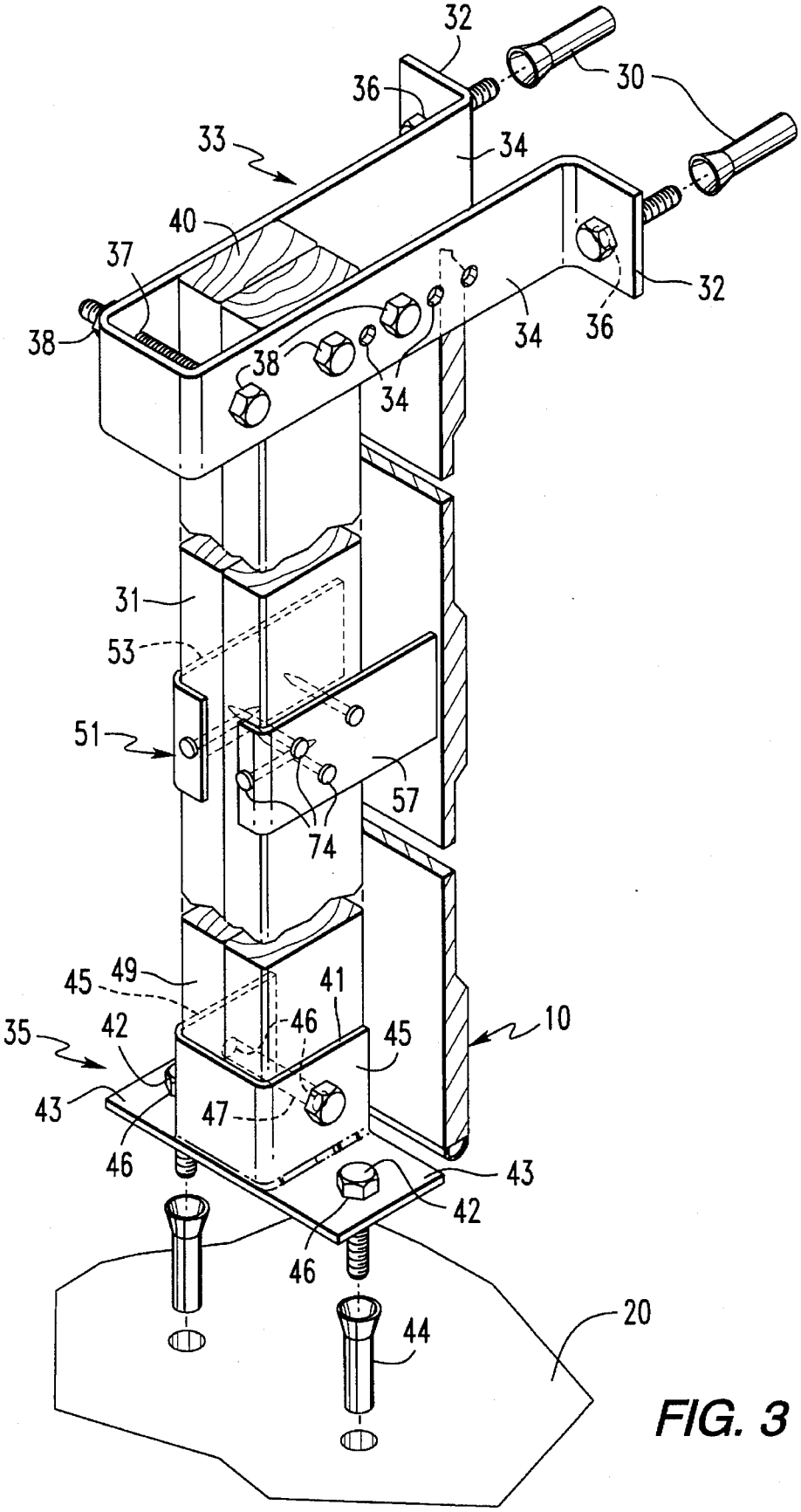
FIG. 3 is a diagrammatic perspective view of a garage door-bracing arrangement in accordance with the present invention.
Figure 4:
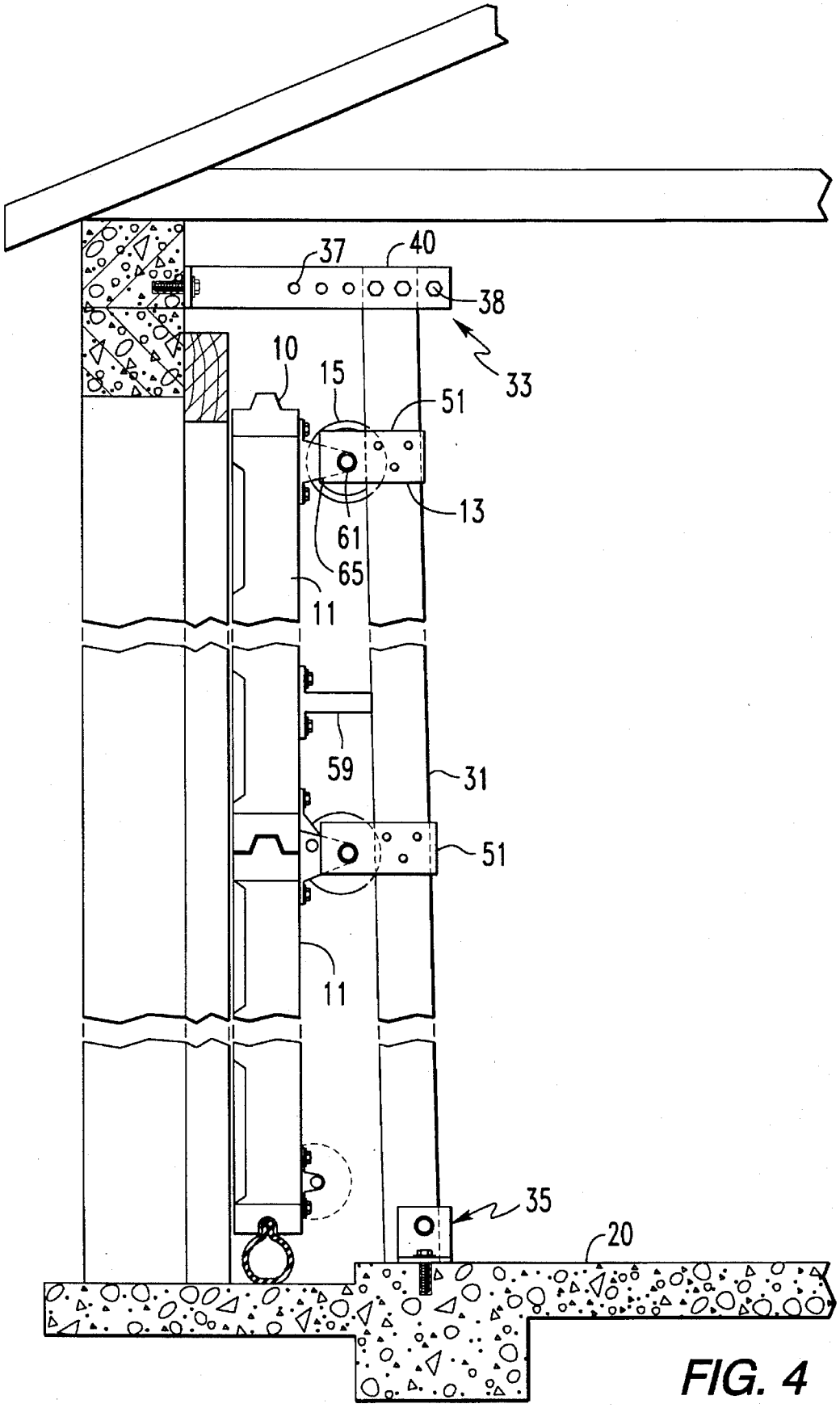
FIG. 4 is a diagrammatic side view of a garage door-bracing column arrangement in accordance with the present invention.

As diagrammatically shown in the perspective view of FIG. 3 and the side view of FIG. 4, a respective upper mounting bracket 33, which may be formed of eighth-inch galvanized steel, or equivalent strength and durability material, is generally U-shaped, having a pair of base flanges 32, that project from side channel walls 34. The bracket 33 may be fastened to the garage wall structure, by way of anchors 30, such as lag bolts or the like, which are secured to expansion plugs fitted into holes drilled into the garage wall structure, the lag bolts passing through holes 36 in the flanges 32. The side channel walls 34 of the upper mounting bracket 33 are dimensioned to accommodate a column member 31 therebetween. A plurality of spaced apart holes 37 may be provided in the side channel walls 34 to secure the upper end 40 of the door-stiffening column member 31 at a selected one of a plurality of respectively different positions relative to the garage building structure without play therebetween, by means of one or more bolts, such as diagrammatically illustrated at 38.

Further diagrammatically illustrated in FIGS. 3 and 4 is a respective lower mounting bracket 35, which may also be formed of eighth-inch galvanized steel, or equivalent strength and durability material. Lower mounting bracket 35 has a generally U-shaped, vertically extending channel portion 41, from which a pair of base flanges 43 extend. In its installed position, lower mounting bracket 35 may be anchored to the garage (concrete) floor by suitable fittings, such as machine bolts 42 or the like, which are secured to drop ins 44 fitted into holes drilled into the garage floor 20, the machine bolts 42 passing through holes 47 in the flanges 43. As shown in FIGS. 3 and 4, there is no attachment between the lower end of the column member 31 and the garage door; instead, the lower end of the column member 31 is secured to the garage floor 20 by means of the lower mounting bracket 35. When not in use, the drop ins 44 may be covered with suitable caps or topped off with a flexible sealant material, such as silicone calk or the like, which is easily removed when installing the machine bolts, in order to anchor the lower bracket members 35 to the garage floor 20. The side walls 45 of the U-shaped channel portion 41 of the lower mounting bracket 35 have mutually aligned holes 46, which are sized to receive a through bolt 47, which passes through a bore in the lower end 49 of the column member 31, so that the lower end of the column member may be securely anchored at the garage floor 20 adjacent to the garage door 10.

As further shown in FIGS. 3 and 4, the door-stiffening column members 31 are arranged to be attachable to deflection brackets 51 that are mounted to the door panel hinge joints 13. With the door-stiffening column members 31 securely to the garage building structure via mounting brackets 33 and 35, and with the garage door panels 11 attached to the thus secured column members 31 via deflection brackets 51, the garage door panels are securely braced by way of a garage door anchoring structure that prevents the garage door from being flexed off the tracks and becoming detached by the impact or vacuum created by intense winds.

Figure 5:
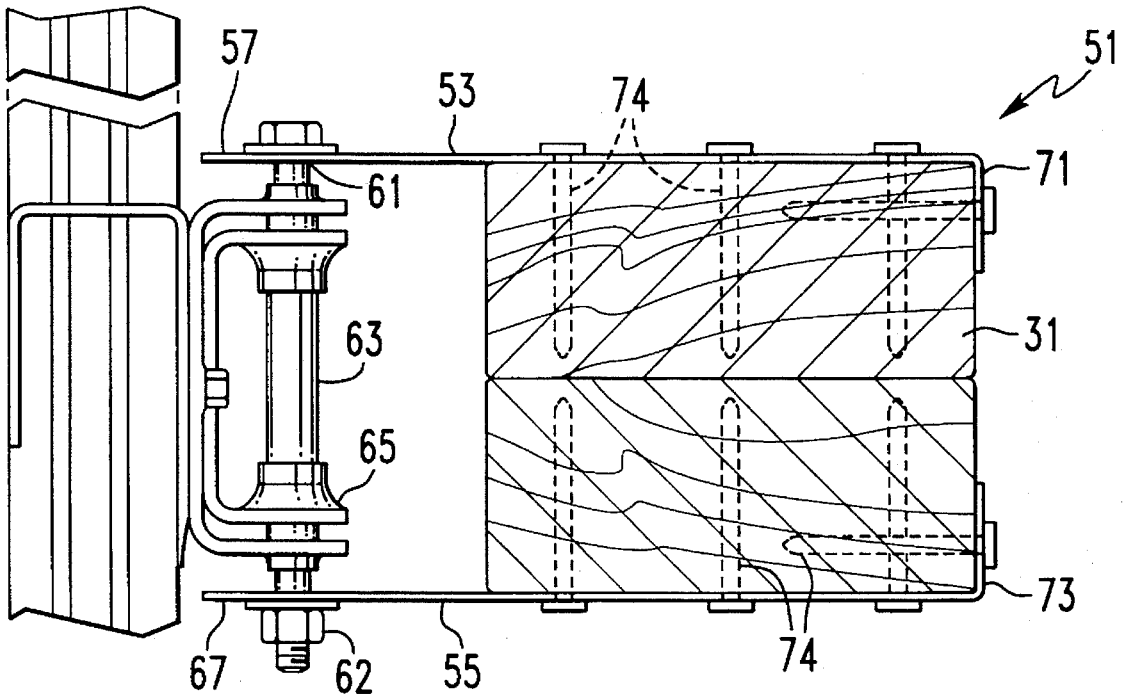
FIG. 5 is a top view of a deflection bracket.

A respective deflection bracket 51 is diagrammatically illustrated in the top view of FIG. 5 as comprising first and second L-shaped deflection bracket members 53 and 55. As a non-limiting example, each L-shaped deflection bracket member may be made of 14 gauge galvanized steel. A first end 57 of L-shaped deflection bracket member 53 has a hole, which is sized to receive a bolt 61 that is sized to pass through a section of tubing 63 of a hinge joint fixture 65, which joins adjacent garage door panels 11 together. Similarly, a first end 67 of L-shaped deflection bracket member 55 has a hole which is sized to receive bolt 61, and allow a nut 62 to be screwed onto a threaded end of bolt 61. Second, L-corner ends 71 and 73 of deflection bracket members 53 and 55 are dimensioned to fit snugly against edge portions of a column member 31. The deflection bracket members 53 and 55 may be secured to the column members by suitable fasteners 74, such as nails or screws, which pass through holes provided for the purpose in the bracket members 53 and 55.

Figure 2:
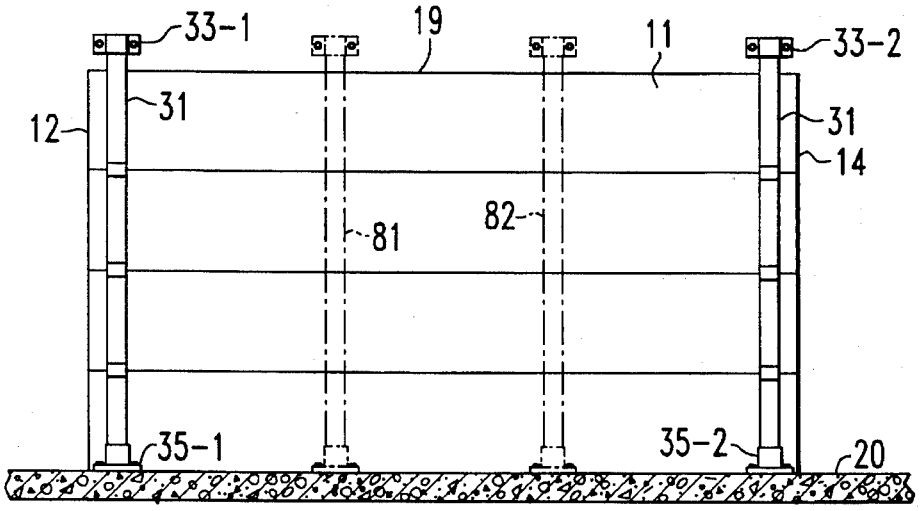
FIG. 2 diagrammatically illustrates a multi-panel configured garage door of the type shown in FIG. 1, braced by a plurality of door-stiffening column members in accordance with the invention.

As diagrammatically illustrated in FIG. 2, first and second ones 33-1 and 33-2 of the upper mounting brackets 33 are affixed to the garage building structure directly above the side edges 12, 14 of the garage door panels 11, with associated first and second ones 35-1 and 35-2 of the lower mounting brackets 35 anchored to the garage floor 20 directly beneath the upper mounting brackets 33-1 and 33-2, respectively. Locating these pairs of upper and lower mounting brackets and immediately adjacent to the side edges of the garage door panels places the vertical bracing at the locations of garage door where it is needed most adjacent to the roller attachments of the garage door panels with the guide tracks. Preferably, as shown in FIG. 4, the anchor points for the upper and lower mounting brackets is such as to place the column members 31 slightly spaced apart from or directly against horizontally extending U-bar members 59 of the garage door 10.

In addition to installing respective pairs of upper and lower mounting brackets to the garage building structure adjacent to the side edges 12, 14 of the garage door panels 11, one or more additional pairs of stiffening column members may be installed to the garage building structure between the side edges of the garage door opening 19, as shown in broken lines 81 and 82 in FIG. 2, so as to provide additional bracing across the width of the garage door 10. With the garage door 10 being attached to these additional column members, the potential for flexing of the garage door panels is effectively minimized, so that the garage door will be securely braced against the wind, thus protecting the interior of the garage and the adjoining building structure.

As will be appreciated from the foregoing description, the vertical column-based garage door bracing arrangement of the present invention not only overcomes the above-described inability of conventional hinged-panel garage doors to withstand strong winds of intense storms such as hurricanes, but it solves the fundamental problem, which is not successfully addressed by recent proposals of the construction industry to install relatively massive girts that extend horizontally across each panel.

As noted previously, the girt installation proposal adds considerable weight to the door itself, while the present invention does not. Once installed, the present invention requires no adjustment of the lifting coil spring and drive of the automated garage door translation mechanism. On the other hand, even with such adjustment to a girt-equipped door, the added weight of the girts will cause further undesirable wear and tear of the automatic door opener. Because the girts extend in the horizontal direction, and are therefore parallel to joint lines between the door panels, the door panels are still subject to torqued rotation when subjected to the force of high velocity winds, so that they do not provide reinforcement or a barrier against separation along the lengths of the tracks.

The bracing system of the present invention, on the other hand, by using a plurality of vertically extending door-stiffening column members that are configured to brace the entire height of the garage door against high velocity winds, effectively prevents any of the door panels from becoming detached as a result of intense winds, such as hurricane-force winds, and thus averting destruction to the garage interior and an adjoining building structure.

While we have shown and described an embodiment in accordance with the present invention, it is to be understood that the same is not limited thereto but is susceptible to numerous changes and modifications as known to a person skilled in the art, and we therefore do not wish to be limited to the details shown and described herein but intend to cover all such changes and modifications as are obvious to one of ordinary skill in the art.

What is claimed:

1. A bracing arrangement for bracing a multi-panel garage door against separation from guide tracks installed along side portions of a garage building structure adjacent to an opening for said multi-panel garage door, said multi-panel garage door having hinge joints between respective panels of said multi-panel garage door, said bracing arrangement comprising:

a plurality of door-stiffening column members, a respective column member having a first end thereof attached to a respective upper mounting bracket that is adapted to be affixed to said garage building structure above said opening for said multi-panel garage door;

a respective upper mounting bracket having a pair of side channel wall portions which receive said respective column member therebetween, each side channel wall portion having an element for fastening said respective upper mounting bracket to said garage building structure above said opening for said multi-panel garage door, and a plurality of spaced apart holes through said each side channel wall portion that are sized to receive one or more fasteners for securely attaching said each side wall channel portion to said column member at a selected one of a plurality of respectively different positions relative to said garage building structure without play therebetween;

one or more deflection brackets adapted to respectively attach one or more door panel hinge joints to said respective column member, a respective deflection bracket having a pair of sidewall deflection members that extend alongside said respective column member, so as to be generally parallel to said pair of sidewall channel portions of said respective upper mounting bracket, said sidewall deflection members having a plurality of spaced apart holes therethrough for receiving one or more fasteners for securely attaching said respective column member to said deflection brackets at a selected one of a plurality of different separations between said respective column member and a respective panel hinge joint, and wherein said pair of sidewall deflection members includes holes alignable with a passageway through a respective door panel hinge joint, receiving a fastener therethrough which is adapted to securely attach said pair of deflection members to said respective door panel hinge joint; and a lower mounting bracket affixed to a second end of said respective column member and having a floor anchoring portion by way of which said column member is adapted to be anchored to a garage floor beneath an attachment location of said respective upper mounting bracket to said garage building structure.

2. A bracing arrangement according to claim 1, wherein said lower mounting bracket is adapted to be solely anchored to said garage floor.

3. A bracing arrangement according to claim 1, wherein said respective upper mounting bracket has a generally U-shaped, unitary piece configuration.

4. A method for bracing a multi-panel garage door against separation from guide tracks installed along side portions of a garage building structure adjacent to an opening for said multi-panel garage door, said multi-panel garage door having hinge joints between respective panels of said multi-panel garage door, said method comprising the steps of:

(a) installing a plurality of door-stiffening column members adjacent to said opening for said multi-panel garage door, by affixing a first end of a respective column member to a respective upper mounting bracket and attaching said respective upper mounting bracket to said garage building structure above said opening for said multi-panel garage door, a respective upper mounting bracket having a pair of side channel wall portions which receive said respective column member therebetween, each side channel wall portion having an element by way of which said respective upper mounting bracket is attached to said garage building structure above said opening for said multi-panel garage door, and a plurality of spaced apart holes through said each side channel wall portion that are sized to receive one or more fasteners securely attaching said each side wall channel portion to said column member at a selected one of a plurality of respectively different positions relative to said garage building structure without play therebetween;

(b) attaching one or more of said respective panels of said multi-panel garage door to one or more of said door-stiffening column members, by means of one or more deflection brackets, a respective deflection bracket having a pair of sidewall deflection members that extend generally away from said multi-panel door and alongside said respective column member, so as to be generally parallel to said pair of sidewall channel portions of said respective upper mounting bracket, said sidewall deflection members having a plurality of spaced apart holes therethrough that receive one or more fasteners securely attaching said respective column member to said deflection brackets at a selected one of a plurality of different separations between said respective column member and a respective panel hinge joint, and wherein said pair of sidewall deflection members includes holes alignable with a passageway through a respective door panel hinge joint, receiving a fastener therethrough which securely attaches said pair of deflection members to said respective door panel hinge joint; and (c) anchoring second ends of said column members to a garage floor portion of said garage building structure by means of lower mounting brackets, a respective lower mounting bracket being affixed to a second end of said respective column member and having a floor anchoring portion by way of which said column member is anchored to a garage floor beneath an attachment location of said respective upper mounting bracket to said garage building structure.

5. A method according to claim 4, wherein, in step (c), said lower mounting brackets, which anchor said second ends of said column members to said garage floor portion of said garage building structure, are detached from said multi-panel garage door.

6. A method according to claim 4, wherein said respective upper mounting bracket has a generally U-shaped, unitary piece configuration.

* * * * *